United States Patent [19]

Mieschke et al.

[11] 4,135,643

[45] Jan. 23, 1979

[54] INGREDIENT METERING FLOW TUBE AND BAFFLE FOR PLASTIC RAW MATERIALS MIXER

[75] Inventors: Rudolf Mieschke, Möglingen; Walter Mücke, Hochberg, both of Fed. Rep. of Germany

[73] Assignee: Filterwerk Mann & Hummel GmbH, Ludwigsburg, Fed. Rep. of Germany

[21] Appl. No.: 787,523

[22] Filed: Apr. 14, 1977

[30] Foreign Application Priority Data

Apr. 15, 1976 [DE] Fed. Rep. of Germany ... 7611930[U]

[51] Int. Cl.[2] ..... B67D 5/22

[52] U.S. Cl. ..... 222/47; 141/198; 222/56; 366/182

[58] Field of Search ..... 222/41, 44, 46, 47, 222/56, 185, 353, 460, 462, 464, 544, 572, 574; 366/162, 181, 182; 198/534; 141/198, 286

[56] References Cited

U.S. PATENT DOCUMENTS

| | | | |
|---|---|---|---|
| 2,684,869 | 7/1954 | Lapple | 302/17 |
| 3,132,768 | 5/1964 | Orr | 222/461 X |
| 3,949,908 | 4/1976 | Baillie | 302/61 X |
| 3,987,934 | 10/1976 | Reed et al. | 222/44 X |
| 3,989,229 | 11/1976 | Noguchi et al. | 141/198 X |

*Primary Examiner*—Allen N. Knowles
*Assistant Examiner*—Fred A. Silverberg
*Attorney, Agent, or Firm*—Joseph A. Geiger

[57] ABSTRACT

A self-interrupting gravity feed device for a plastic raw materials mixer comprising a vertical flow tube which reaches from above into the mixer receptacle, and a horizontal baffle arranged at a distance from the lower opening of the flow tube. The baffle is similar in shape and at least as large in diameter as the flow tube opening and it is preferably vertically adjustable in relation to the flow tube.

7 Claims, 5 Drawing Figures

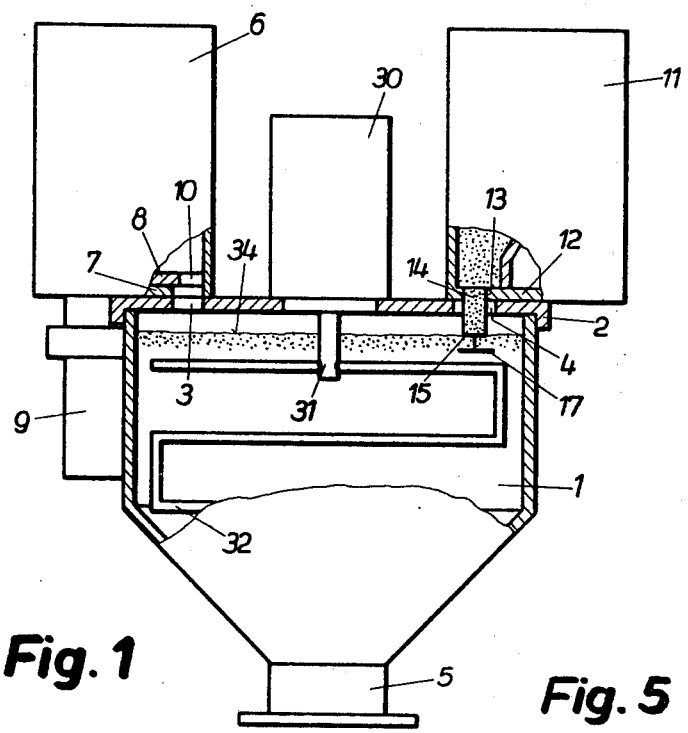
Fig. 1
Fig. 5
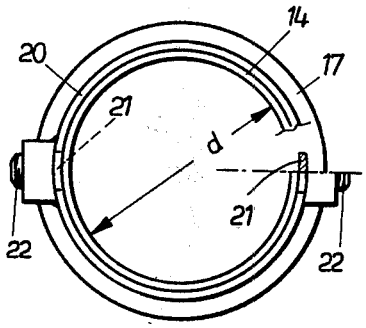
Fig. 4
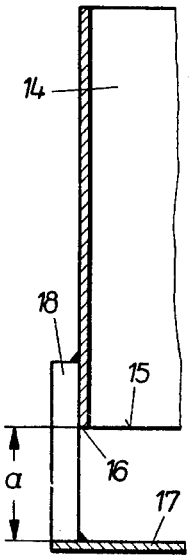
Fig. 2
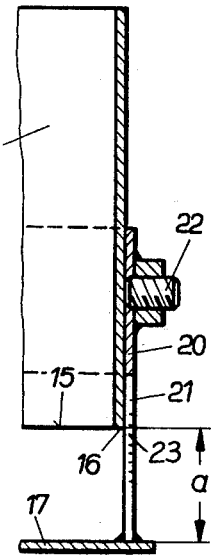
Fig. 3
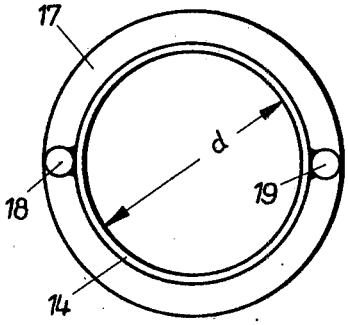

INGREDIENT METERING FLOW TUBE AND BAFFLE FOR PLASTIC RAW MATERIALS MIXER

BACKGROUND OF THE INVENTION

1. Field of the Invention

The present invention relates to mixing and dispensing devices, and, more particularly, to plastic raw materials mixers for use in conjunction with plastic materials processing machines, such as extruders and injection molding machines, where a plurality of ingredients of granular and/or pulverulent consistency are combined at predetermined ratios and fed to the processing machine.

2. Description of the Prior Art

Different methods may be used to automatically supply a predetermined quantity of a given mixture of plastic raw materials to a plastics processing machine. One approach involves the separately metered supply of each ingredient to a mixing receptacle, at a rate which is controlled by the rate at which the mixture is consumed. This approach requires complex and costly metering equipment, if ready adaptability to different production rates and changing raw material compositions is desired.

Another approach, featured by the present invention, involves the self-interrupting gravity feed of the major raw material component into the mixer receptacle in combination with the metered, machine-paced supply of one or more additives, such as pigments and the like, to the mixer. In order to achieve such a self-interrupting gravity feed, this type of mixing device commonly has a dip tube which reaches into the mixer receptacle from above, and through which the raw material enters the receptacle by gravity, the flow being blocked, or at least slowed, when the level of the materials inside the mixer receptacle reaches the opening of the dip tube.

One such prior art device is disclosed in U.S. Pat. No. 830,543, the device featuring three dip tubes discharging raw materials into separate regions of the mixer receptacle. As the various raw materials flow downwardly through the dip tubes into the mixer receptacle, the latter is rotated around a vertical axis, so that the raw materials are deposited in the receptacle along horizontal circular paths. The gravity discharge of raw materials into the mixer receptacle continues until the level of the materials inside the receptacle reaches the dip tube openings, thereby first slowing and eventually stopping further discharge into the receptacle, when the dip tube openings are completely covered by previously discharged materials. As a portion of the mixed materials is consumed by the plastics processing machine, the materials level inside the mixer receptacle falls, thereby allowing proportionate amounts of raw materials to be discharged from the dip tubes.

While this type of arrangement works satisfactorily with certain granular materials, it has been found to malfunction with other materials, particularly with very freely flowing ingredients which have a tendency to continue flowing into the mixer receptacle, even though the materials level inside the latter is covering the opening of the dip tube. The result is an undesirably high fill level inside the mixer receptacle, accompanied by a distortion of the mixing ratios.

Among past attempts at a solution to this problem is the suggestion of orienting the discharge opening of the dip tube against the path of the materials which rotate in the mixer receptacle by either arranging an oblique opening on the dip tube, or by using an elbow-type dip tube. In practical use, however, both of these suggestions have fallen short of expectations, because they still require adjustment, in order to compensate for changes in the speed of rotation of the mixer and for differences in the flowability of the various raw materials which are to be processed. These adjustments are tricky and difficult to obtain with consistency.

SUMMARY OF THE INVENTION

It is a primary objective of the present invention to devise an improved self-interrupting ingredient metering flow tube which is simple in construction and which operates reliably under different flow conditions.

The present invention proposes to attain this objective by suggesting the combination of a vertically downwardly opening flow tube with a horizontal baffle arranged at a distance from the lower opening of the flow tube, the baffle being flat and having a contour similar to that of the flow tube opening, with dimensions which are at least as large as those of said opening. The proposed combination creates a radially oriented discharge opening which preferably extends over at least a major portion of the flow tube circumference.

The baffle facing the opening of the flow tube effectively balances the raw material column which presses downwardly inside the latter. The result is a practically complete cessation of after-flow of raw material from the flow tube opening, when the latter is surrounded with already discharged raw material ingredients, so that an overfilling of the mixer receptacle is safely precluded. The baffle is preferably somewhat larger in diameter than the flow tube, so as to protrude over the circumference of the latter. This configuration has been found to provide maximum assurance against after-flow from the flow tube into a full mixer receptacle.

Practical tests have further established that the vertical distance between the baffle and the lower opening of the flow tube should preferably be equal to at least one-quarter and at most three-quarters of the maximum inner diameter of the lower flow tube opening. A distance near the lower end of this range is recommended for very freely flowing raw material ingredients, or in the case of a low flow rate through the self-interrupting flow tube. A recommended average distance between a circular flow tube opening and a likewise circular baffle is one-half of the diameter of the flow tube opening.

By way of a further improvement, the present invention also suggests that the distance between the lower flow tube opening and the baffle be made adjustable, so as to permit a convenient quick adaptation of the device to different flow rates and to different flow characteristics of the various raw material ingredients which are to be metered through the flow tube. Such an adjustability may be provided by means of a simple collar which carries the baffle on narrow vertical ribs, and which is clamped against the lower end portion of the flow tube by means of suitable set screws. Optimal distance settings can thus readily be determined by experimentation and recorded for future resetting, when required. Preferably, the manufacturer of the raw materials mixer also supplies a table of guide settings for various operational conditions.

BRIEF DESCRIPTION OF THE DRAWING

Further special features and advantages of the invention will become apparent from the description following below, when taken together with the accompanying drawing which illustrates, by way of example, preferred embodiments of the invention, represented in the various figures as follows:

FIG. 1 shows, in a partially cross-sectioned elevational view, an installation for metering and mixing plastic raw material ingredients, using a self-interrupting flow tube as suggested by the present invention;

FIG. 2 shows, in an enlarged elevational cross section, a portion of the flow tube of FIG. 1 with a baffle which is arranged at a fixed vertical distance from the flow tube opening;

FIG. 3 shows a modification of the flow tube and baffle combination of FIG. 2, the distance of the baffle from the flow tube opening being adjustable;

FIG. 4 shows the flow tube and baffle of FIG. 2 in a plan view; and

FIG. 5 shows the flow tube and baffle of FIG. 3 in a similar plan view.

DESCRIPTION OF THE PREFERRED EMBODIMENTS

Referring to FIG. 1 of the drawing, there is illustrated, in a somewhat schematic representation, a rotary mixer for plastic raw materials which are to be fed to a plastic processing machine, such as an extruder or an injection molding machine. This mixer consists essentially of a round mixer receptacle 1 whose upper end is closed off by means of a cover 2 with two openings 3 and 4 for the supply of raw material ingredients to the inside of the mixer receptacle 1. A mixture withdrawal duct 5 on the bottom of the mixer receptacle 1 also serves as mounting base for the mixer on the plastics processing machine.

The opening 3 serves as an inlet for an additive, for example a pigment, whose feed rate to the mixer receptacle 1 is controlled by a metering device 6 in a known manner. The metering device 6 has a bottom wall 7 by which it is attached to the mixer cover 2. Above the bottom wall 7 is arranged a metering disc 8 which rotates on a vertical axis and which has a series of metering pockets 10 arranged on its periphery. An electric motor 9 drives the metering disc 8. A partition wall (not shown) inside the housing of the metering device 6 maintains an empty space above the inlet opening 3, so that each metering pocket 10, which travels from this empty space to the space containing the ingredient supply, carries back a predetermined quantity of that ingredient which is being discharged through the opening 3, as soon as the metering pocket 10 arrives above the latter. This type of constant-increment metering device is known in the art, so that additional details of structure and operation of the device are deemed unnecessary for an understanding of the present invention.

Above the inlet opening 4 of the mixer cover 2 is arranged a raw material receptacle 11, holding a granular or pulverulent raw material ingredient. In the bottom wall 12 of the receptacle 11, above the inlet opening 4, is provided a bore 13 for a vertical flow tube 14. The latter is preferably removably mounted on the bottom wall 12, using, for example, a suitable mounting flange (not shown). Alternatively, the flow tube 14 may be directly attached to the bore 13 itself, using a threaded connection, for example. The connection between the flow tube 14 and the bottom wall 12 of receptacle 11 is preferably of the quick-release type, making it possible to quickly exchange one flow tube for another.

As can be seen in FIG. 1, the flow tube 14 reaches downwardly into the mixer receptacle 1 to the material fill level 34. Two different embodiments of such a flow tube are shown at an enlarged scale in FIGS. 2 and 3. There, it can be seen that the flow tube 14 has a lower opening 15 whose edge 16 runs in a substantially horizontal plane. The flow tube embodiments shown here have a regular circular cross section, with a circular lower opening 15, but it should be understood that the present invention is also applicable to flow tubes having a noncircular lower opening. The outline of the latter may be square, rectangular, or oval, for example.

Below the lower opening 15 of the flow tube 14, at a vertical distance a from its edge 16, is arranged a substantially horizontally oriented baffle 17. The latter is preferably a simple circular disc, having an outer diameter which protrudes slightly over the circumference of the flow tube 14. In the embodiment of FIG. 2, which is also shown in FIG. 4 in a plan view, the baffle 17 is permanently attached to the flow tube 14, at a fixed distance a from the edge 16 of the latter, by means of two vertical spacer studs 18 and 19 which are preferably welded to the baffle 17 and to the flow tube 14. The fixed distance a of this embodiment is preferably equal to about one-half of the interior diameter d of the lower flow tube opening 15.

A second embodiment of the invention, with a modified baffle 17, is shown in FIG. 3, and in the plan view of FIG. 5. Here, the baffle 17 is provided with vertical adjustability in relation to the flow tube edge 16, for the setting of a variable vertical distance a. For this purpose, the flow tube 14 is surrounded by a positioning collar 20, with an appropriate movement clearance between the outer diameter of the flow tube 14 and the inner diameter of the collar 20. Two internally threaded eyes on the positioning collar 20 hold matching set screws 22 by means of which the collar 20 can be clamped against the flow tube 14 in any desired vertical position. Two narrow vertical ribs 21 connect the baffle 17 to the positioning collar 20 (see also FIG. 5). Both flow tube versions thus have a radially oriented discharge opening of a height a and extending over the entire circumference of the flow tube, with the exception of the spacer studs 18 and 19, or the vertical ribs 21, respectively.

FIG. 1 also shows an electric motor 30 which is mounted centrally on the mixer cover 2. This motor 30 has a vertical drive shaft 31 reaching into the mixer receptacle 1 and carrying on its lower extremity a mixing implement 32 of known configuration. In operation, the motor 30 rotates the mixing implement 32 inside the mixer receptacle 1, thereby mixing the raw material ingredients contained inside said receptacle by moving them along circular horizontal paths.

When the mixing device of FIG. 1 is initially placed into operation, the main raw material ingredient is allowed to flow from the raw material receptacle 11 into the mixer receptacle 1, via the flow tube 14. Raw material will continue to flow into the mixer receptacle 1, until the material level 34 has reached the edge 16 of the lower opening 15 of the flow tube 14. While the main raw material ingredient flows from the receptacle 11 into the mixer receptacle 1, the motor 30 is operated to rotate the mixing implement 32.

The baffle 17 facing the lower opening of the flow tube 14, and thereby supporting the column of raw material which presses downwardly through the flow tube 14, prevents the discharge of additional material into the mixer receptacle 1, as soon as the materials inside the latter reach the edge 16 of the flow tube opening 15, so as to cover the entire radial opening of the flow tube 14. As long as no withdrawal of mixed raw materials through the mixture withdrawal duct 5 of the mixer receptacle takes place, there will be no perceptible additional inflow of raw material through the flow tube 14, regardless of whether the mixing implement 32 rotates or not.

The metering device 6, as mentioned earlier, supplies an additive material to the mixer receptacle 1. While FIG. 1 shows only a single metering device mounted on the mixer cover 2, there may, of course, exist situations where additional metering devices are required. On the other hand, it is also possible to employ metering devices of different structure and operation, such as pump-type metering devices, for example.

Following the initial filling of the mixer receptacle 1, the mixing implement 32 continues its rotation, until a preprogrammed mixing time has passed. The movement of the mixing implement 32 causes the raw material ingredients contained inside the mixer receptacle 1 to move in substantially horizontal circular paths. As soon as a portion of the raw material mixture is withdrawn through the discharge duct 5 to be processed by the plastics processing machine, the raw materials level 34 inside the receptacle 1 falls accordingly, thereby exposing the lower opening 15 of the flow tube 14. As a result, a corresponding quantity of raw material will flow from the raw material receptacle 11 into the mixer receptacle 1. This flow is automatically stopped, as soon as the raw material level 34 has again reached the level of the flow tube opening 15. A suitable control device (not shown) in the motor controls of the metering device 6 starts and stops the latter in response to the operation of the plastics processing machine, thereby adding a precise quantity of additive, such as a pigment, for example.

The operational sequence described above is repeated during each operational cycle of the plastics processing machine, if the latter is an injection molding machine, for example. In the case of a continuously operating extruder, the raw materials mixer may similarly operate in a continuous fashion, or it may be subject to extruder-triggered start-stop controls.

In order to avoid the need for emptying and cleaning of the raw material receptacle 11 each time there is a change in the raw material requirements of the plastics processing machine, the receptacle 11 may further be provided with a suitable shutoff valve above the bore 13 of its bottom wall 12, so that the flow of raw materials through the flow tube 14 can be stopped completely. The receptacle 11 can then be lifted from the mixer cover 2, while still containing a supply of raw material. In this fashion, it is possible to conveniently and quickly exchange one raw material container for another raw material container which holds a different supply of raw material.

While the circular shape is the simplest and most convenient shape for the flow tube 14 and the baffle 17, it should be understood that the present invention is not limited to this preferred shape and that various non-circular shapes could be employed. In all cases, however, the baffle 17 should have a shape which is similar to the shape of the lower opening 15 of the flow tube 14, and its horizontal extent should be at least equal to the area occupied by said opening. The vertical distance a between the baffle 17 and the edge 16 of the lower flow tube opening 15 should, for all practical purposes, be equal to at least one-quarter, and at most three-quarters, of the maximum interior diameter of the lower opening 15 of the flow tube 14. If the outline of the flow tube opening is chosen to be non-circular, such as square or rectangular, for example, its maximum diameter should be measured on the diagonal line of such an outline; in the case of an oval flow tube opening, the maximum diameter of the latter would be the diameter measured on the major axis of the outline.

In order to achieve a convenient and quick repeatability of the height adjustments a on the baffle 17, its connecting ribs 21, or the outside of the flow tube 14, may be provided with appropriate scale markings 23.

It should be understood, of course, that the foregoing disclosure describes only preferred embodiments of the invention and that it is intended to cover all changes and modifications of these examples of the invention which fall within the scope of the appended claims.

We claim the following:

1. A self-interrupting gravity feed device which is particularly suited for use as an ingredient intake metering means of a plastic raw materials mixer, in conjunction with a hopper-type supply source of a flowable granular or pulverulent plastic raw material ingredient and a mixer receptacle arranged therebelow in which a plurality of raw material ingredients are mixed in a rotating motion of the ingredients about a vertical axis, and from which the raw materials mixture is withdrawn by a plastic materials processing machine, the device comprising in combination:

a flow tube open on both ends and serving as a gravity flow conduit between said supply source and the mixture receptacle, the flow tube reaching a distance into said receptacle and having at least its lower end portion oriented substantially vertically and the contour of its lower opening coinciding substantially with a horizontal plane; and a substantially flat baffle carried by the flow tube, at a distance below its lower opening and in substantially parallel alignment therewith, the baffle having a contour which is similar to that of the lower flow tube opening and dimensions which are at least as large as those of said opening, thereby creating a discharge opening which is oriented radially with respect to the flow tube axis and which extends over at least a major portion of the flow tube circumference, so that, when the level of the rotating raw material ingredients inside the mixer receptacle reaches the level of the flow tube opening, the gravity discharge of said flowable raw material ingredient from the flow tube is substantially halted, until said level recedes again, as some of the materials mixture is withdrawn from the mixing receptacle.

2. A device as defined in claim 1, wherein the flow tube is a straight length of round tubing; and the baffle is a round disk being permanently attached to the lower extremity of the flow tube by means of at least one narrow vertical spacer stud extending between the peripheries of the flow tube and baffle.

3. A device as defined in claim 1, wherein the distance a between the lower opening of the flow tube and the baffle is equal to at least one-quarter and at most three-quarters of the maximum inner diameter d of the flow tube opening.

4. A device as defined in claim 3, wherein the lower flow tube opening and the baffle are both circular in outline; and said distance a is equal to one-half of said diameter d.

5. A device as defined in claim 1, wherein the flow tube and the baffle define between them means for adjusting the distance between the lower opening of the flow tube and the baffle.

6. A device as defined in claim 5, wherein the distance adjusting means includes a positioning collar surrounding the lower end portion of the flow tube with clearance, at least one set screw adjustably clamping said collar against the flow tube, and at least one vertical rib attaching the baffle to the positioning collar.

7. A device as defined in claim 6, wherein the distance adjusting means includes adjustment markings on one of the relatively adjustable parts.

* * * * *